US007818853B2

(12) United States Patent
Noelle et al.

(10) Patent No.: US 7,818,853 B2
(45) Date of Patent: Oct. 26, 2010

(54) DRUM, PARTICULARLY FOR A MACHINE FOR ENTANGLING A NONWOVEN FABRIC USING WATER JETS

(75) Inventors: Frédéric Noelle, Saint Nazaire les Eymes (FR); Christian Decolin, Montbonnot (FR)

(73) Assignee: Rieter Perfojet, Montbonnot (FR)

( * ) Notice: Subject to any disclaimer, the term of this patent is extended or adjusted under 35 U.S.C. 154(b) by 743 days.

(21) Appl. No.: 11/718,745

(22) PCT Filed: Nov. 4, 2005

(86) PCT No.: PCT/FR2005/002746

§ 371 (c)(1),
(2), (4) Date: Jun. 4, 2007

(87) PCT Pub. No.: WO2006/051191

PCT Pub. Date: May 18, 2006

(65) Prior Publication Data

US 2008/0092350 A1 Apr. 24, 2008

(30) Foreign Application Priority Data

Nov. 10, 2004 (FR) ..... 04 11975

(51) Int. Cl.
*D04H 3/10* (2006.01)
*D04H 5/02* (2006.01)
*D06B 23/02* (2006.01)

(52) U.S. Cl. ..... 28/104; 28/167

(58) Field of Classification Search ..... 28/104, 28/105, 167, 106, 163; 492/28, 30–36; 162/296, 162/297, 310, 357
See application file for complete search history.

(56) References Cited

U.S. PATENT DOCUMENTS

| | | | | | |
|---|---|---|---|---|---|
| 412,359 | A | * | 10/1889 | Boyne | 492/36 |
| 669,444 | A | * | 3/1901 | Klitsch | 474/185 |
| 1,175,940 | A | * | 3/1916 | Farnsworth et al. | 162/372 |
| 1,627,966 | A | * | 5/1927 | Goodlett | 162/282 |
| 2,009,848 | A | * | 7/1935 | Keltie | 156/188 |
| 2,862,251 | A | | 12/1958 | Kalwaites | |
| 3,214,819 | A | | 11/1965 | Guerin | |
| 3,508,308 | A | | 4/1970 | Bunting, Jr. et al. | |
| 3,787,932 | A | * | 1/1974 | Kalwaites | 28/105 |
| 4,190,695 | A | | 2/1980 | Niederhauser | |
| 5,098,764 | A | * | 3/1992 | Bassett et al. | 428/131 |
| 5,274,893 | A | * | 1/1994 | Kitamura et al. | 28/105 |
| 5,301,401 | A | | 4/1994 | Suzuki et al. | |
| 5,414,914 | A | * | 5/1995 | Suzuki et al. | 28/105 |
| 5,585,017 | A | * | 12/1996 | James et al. | 219/121.71 |
| 5,609,046 | A | | 3/1997 | Fleissner | |
| 5,632,072 | A | * | 5/1997 | Simon et al. | 26/69 R |
| 5,768,756 | A | | 6/1998 | Noelle | |
| 5,791,028 | A | | 8/1998 | Zolin | |

(Continued)

FOREIGN PATENT DOCUMENTS

WO 96/36756 A1 11/1996

*Primary Examiner*—Amy B Vanatta
(74) *Attorney, Agent, or Firm*—Pearne & Gordon LLP

(57) ABSTRACT

The invention relates to a drum wherein the lateral surface thereof is provided with perforations that are separated by full parts from recessed parts and which are present on the full parts with an outer lateral surface. Application: in an entanglement machine for a nonwoven, using water jets.

18 Claims, 3 Drawing Sheets

U.S. PATENT DOCUMENTS 6,024,553 A * 2/2000 Shimalla ..... 425/290
6,324,738 B1 * 12/2001 Fleissner ..... 28/104
6,660,361 B1 12/2003 Shimalla
6,865,784 B2 * 3/2005 Noelle ..... 28/104
7,421,766 B2 * 9/2008 Munstermann ..... 28/167
7,530,150 B2 * 5/2009 Brennan et al. ..... 28/104
2002/0004348 A1 * 1/2002 Kelly et al. ..... 442/327
2002/0034914 A1 * 3/2002 De Leon et al. ..... 442/384

* cited by examiner

DRUM, PARTICULARLY FOR A MACHINE FOR ENTANGLING A NONWOVEN FABRIC USING WATER JETS

The present invention relates to machines for producing woven, knitted and non-woven textile products by the technique known as the pressurised "water jet" method.

The publications U.S. Pat. Nos. 3,214,819, 3,508,308 and 4,190,695 describe a method of producing non-woven textile fabrics in which the cohesion and intertwining of the elementary fibres with one another are achieved by the action of a plurality of high-pressure water jets passing through a fabric or cloth moving over a perforated support.

The publication U.S. Pat. No. 5,791,028 describes a machine for treating textile products with water jets on aspirating rotary drums.

Whether they are intended for the production of non-woven fabrics or for textile treatment, the perforated rotary drums are generally thick rigid metal tubes pierced with cylindrical or conical holes. These drums are not in direct contact with the textile materials as their openings are too large. In particular, they are covered by supports perforated with small holes, such as metal or plastic fabrics.

EP 0776391, more recently, described a thin sleeve the wall of which is perforated with randomly distributed micro-openings.

Even more recently it has been proposed to etch and pierce thin plastic tubes using a laser in order to provide three-dimensional designs on non-wovens by the effect of water jets.

All these supports for treating textiles and bonding non-wovens by the action of water jets, metal and plastic fabrics, microperforated sleeves and laser-etched sleeves have the common feature of being thin and having little rigidity. In particular, where industrial manufacturing components are concerned, they are several meters long.

For this reason these thin supports are supported by thick rigid perforated drums. It is known, for example, to use rotary drums with a so-called honeycomb structure. This technical solution is onerous but has the advantage of providing a very large open surface, ranging from 75 to 90%, which results in an excellent and very uniform drainage of the water from the water jets with vacuum aspiration of air inside the drum, facing the injectors that supply the water jets.

A much less complicated technical solution than the honeycomb structure comprises using drums pierced with cylindrical or conical holes. These less expensive drums have the main drawback of an open surface of less than 80% and more generally of the order of 30 to 60%. When these drums perforated with holes are used as a support for perforated sleeves and fabrics, they generate problems of uniformity of aspiration and drainage of the water from the water jets. A loss of efficacy of the water jets is observed as well as some defects in appearance, particularly in the zones corresponding to the solid parts of the drum separating the holes of the drum. In U.S. Pat. No. 5,609,046, metal strips are welded onto the drum, whereas in U.S. Pat. No. 6,660,360 B1 they are added on. In both cases, there is deflection of the jets, defects are found on the fabric and perforations are blocked off.

In order to remedy these disadvantages of loss of efficacy and these defects in appearance, the current practice is to interpose a coarse-mesh metal fabric between the perforated drum and the outer sleeve which receives the water jets.

Even though this technique results in a significant improvement in the drainage of the water and a marked reduction in the defects in appearance, it also gives rise to a number of drawbacks and in particular some sticking of the constituent materials of the textiles and non-wovens, such as fibres, filaments, fragments of fibres or filaments and sizing products present on the fibres. This sticking phenomenon is all the more noticeable the higher the pressures used for the water jets. This phenomenon of fibres sticking increases over time and necessitates more and more frequent cleaning. This requires the shutdown of the production line or even the replacement of parts which have become unusable. In some cases it is impossible to remove the perforated sleeves and they then have to be destroyed and replaced with new parts.

The invention overcomes these disadvantages by a particular design of the surface of the perforated rotary drum. The drum according to the invention can receive all types of metal or plastic fabrics, microperforated thin metal sleeves, metal sleeves the surface of which has previously been embossed and laser-etched plastic sleeves.

The drum according to the invention provides excellent and uniform drainage of the water from the water jets and substantially improves the quality of the non-wovens produced, without leading to the sticking of the textile materials such as the fibres and other components of the textile products, irrespective of the water pressures used for the water jets.

The drum according to the invention also allows easy removal of the outer sleeves without subjecting them to any damage.

The non-wovens produced with a drum according to the invention are free from marks or impressions from the drum, whatever the pressure of the jets.

The invention relates to a drum the outer side face of which is provided with perforations separated by solid parts, characterised by recessed parts which are machined in the solid parts on the outer side face.

The recessed parts can easily be obtained by machining.

The recessed parts of the side face are obtained by machining the already cylindrical blank of the drum. Machining is in fact a cheap method of producing recessed parts, grooves or hollows having the preferred dimensions. Machining also ensures that the dimensions are highly accurate and weakens the solid parts as little as possible.

The ratio of the surface area of the perforations to the total surface area of the outer side face is between 30% and 90%, but preferably between 60 and 80%, thus considerably reducing the deflections of the jets.

The thickness of the side wall of the drum is preferably between 1 mm and 60 mm and preferably between 5 mm and 40 mm. The perforations are between 3 and 20 mm in diameter.

The thickness of the recessed parts is preferably between 0.25 mm and 5 mm and more preferably between 0.5 mm and 2 mm and their width is between 0.6 and 20 mm.

Preferably, the length of a non-recessed part represents from 30 to 100% of the diameter of a perforation and the width is between 0.6 and 4 mm, preferably 2 mm.

In the most preferred embodiment the ratio of the surface of the recessed parts to the surface of the solid parts is greater than 70 and preferably between 70 and 95. The drum is preferably made of bronze or stainless steel and has an outer diameter of between 200 mm and 1200 mm. The perforations are preferably cylindrical or conical and their circular cross section makes the production of the drum much easier. Preferably, the water jets are from 50 to 250 μm in diameter and the pressure of the water is preferably from 10 to 500 bar.

According to a highly preferred embodiment which allows for maximum opening of the drum, a recessed part opening onto two adjacent perforations is located on the line passing through the centres of these two perforations and, better still, there are only two recessed parts opening onto each perforation. The recessed parts are interrupted by perforations. Two recessed parts start from diametrically opposite points of each perforation. The diameters which have just been discussed, if they are not aligned, are parallel from one pair of perforations to another.

The invention also relates to a machine for entangling a non-woven material by means of water jets, comprising a drum, rotary drive means for the drum, a sleeve provided with openings which is pulled over the drum and an injector system arranged so as to spray water jets over the outer side face of the sleeve, characterised in that the drum is as defined according to the invention.

Preferably, the openings, which are in particular cylindrical, are between 30 and 800 μm in their larger dimension and the sleeve has a thickness between 0.10 mm and 3 mm. The ratio of the surface area of the openings in the sleeve to the total surface area of the outer side face is preferably between 5% and 50%.

In the attached drawings, provided solely by way of example:

Figure 1:
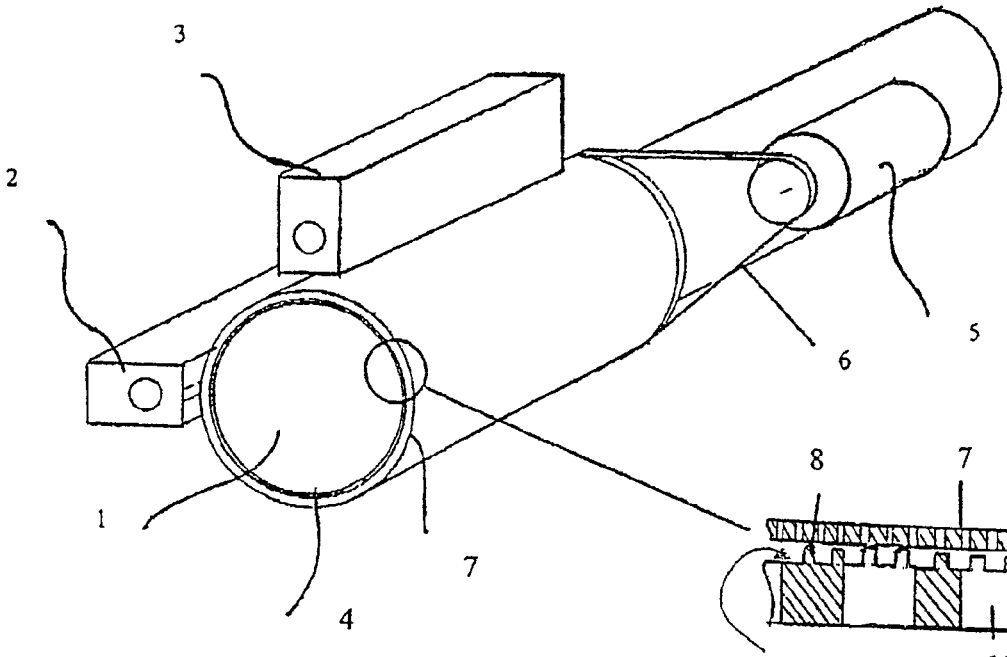
FIG. 1 is a diagrammatic perspective view of a machine for entangling a non-woven fabric by means of water jets according to the invention.

The machine shown in FIG. 1 comprises a fixed hollow body 1 which is pierced with slots facing injectors 2 and 3 adapted to deliver water jets 150 microns in diameter under a pressure of 250 bar.

The body 1 is surrounded by a perforated drum 4 which is rotationally driven about its axis by a motor 5 by means of a drive mechanism 6. The drum 4 is surrounded by a sleeve 7 perforated with openings 200 μm in diameter, which may be a woven fabric, a microperforated thin metal sheath, an embossed sleeve or a laser-etched plastic sleeve.

The injectors 2, 3 are arranged so as to spray water jets over the outer side face of the sleeve.

Figure 2:
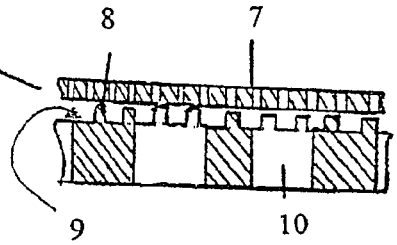
FIG. 2 is a partial sectional view of the part circled in FIG. 1.

In FIG. 2, the drum 4 has non-recessed or intact parts 8 which come from the outer side face and recessed parts 9 machined in the surface of the drum 4 which is directed towards the sleeve 7. The parts 8 define cylindrical perforations 10 passing through. The free ends of the parts 8 are in contact with the inner surface of the sleeve 7.

Figure 3:
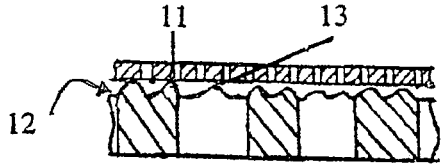
FIG. 3 is a view analogous to FIG. 2 showing an alternative embodiment.

In FIG. 3, the drum comprises non-recessed parts 11 and hollows 12, the peaks 13 of the non-recessed parts pointing towards the sleeve 7 being in contact with the inner surface of the latter.

Figure 4:
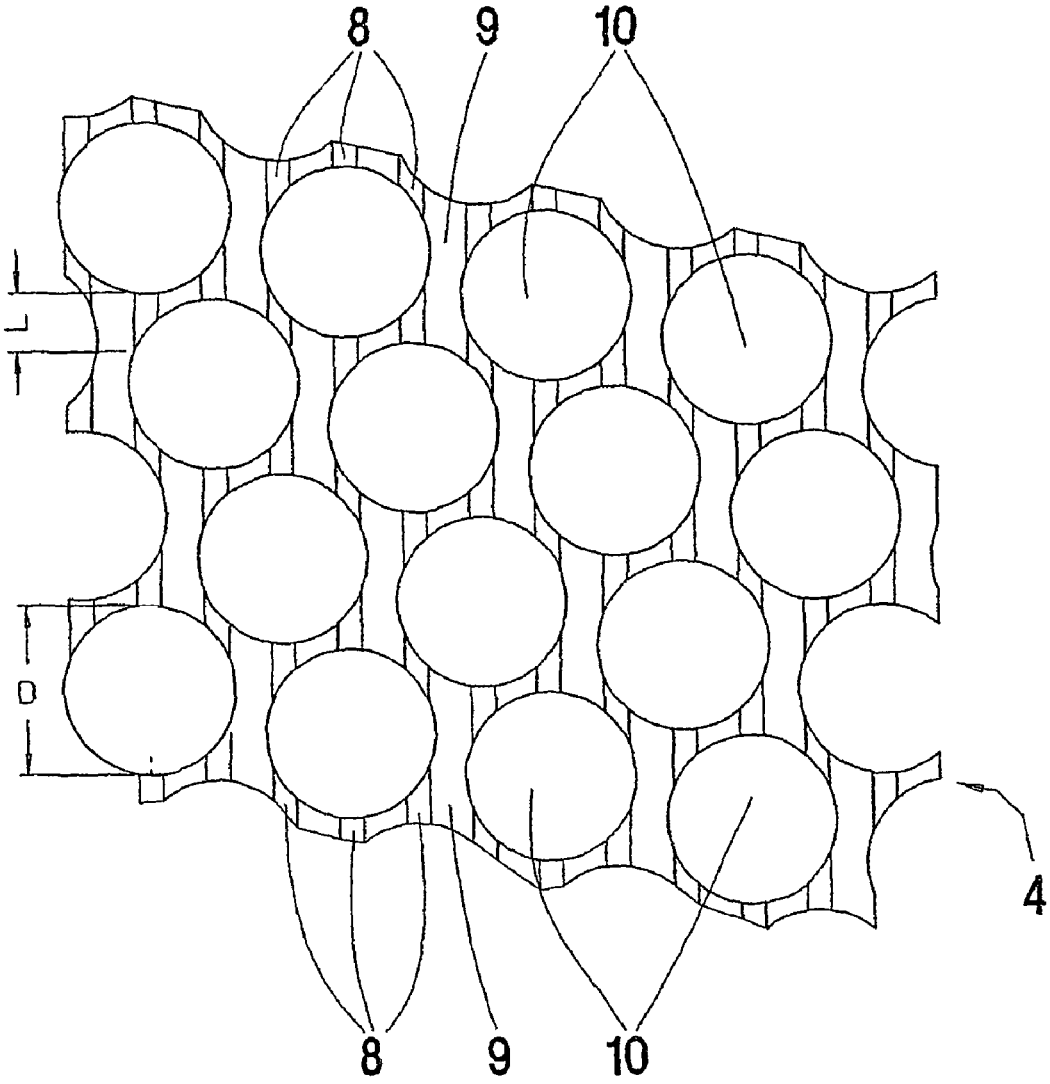
FIGS. 4 and 5 are partial views of developments of two embodiments.

In FIG. 4, the perforations 10 are arranged in spiral rows. The diameter D of the perforations 10 is 10 mm. The length L of the non-recessed parts is approximately 4 mm. The width of the recessed parts 9 is 2 mm. All the recessed parts 9 open onto the perforations. The whole of the outer surface of the drum is at one level, with the exception of the recessed parts 9 which are sunken.

Figure 5:
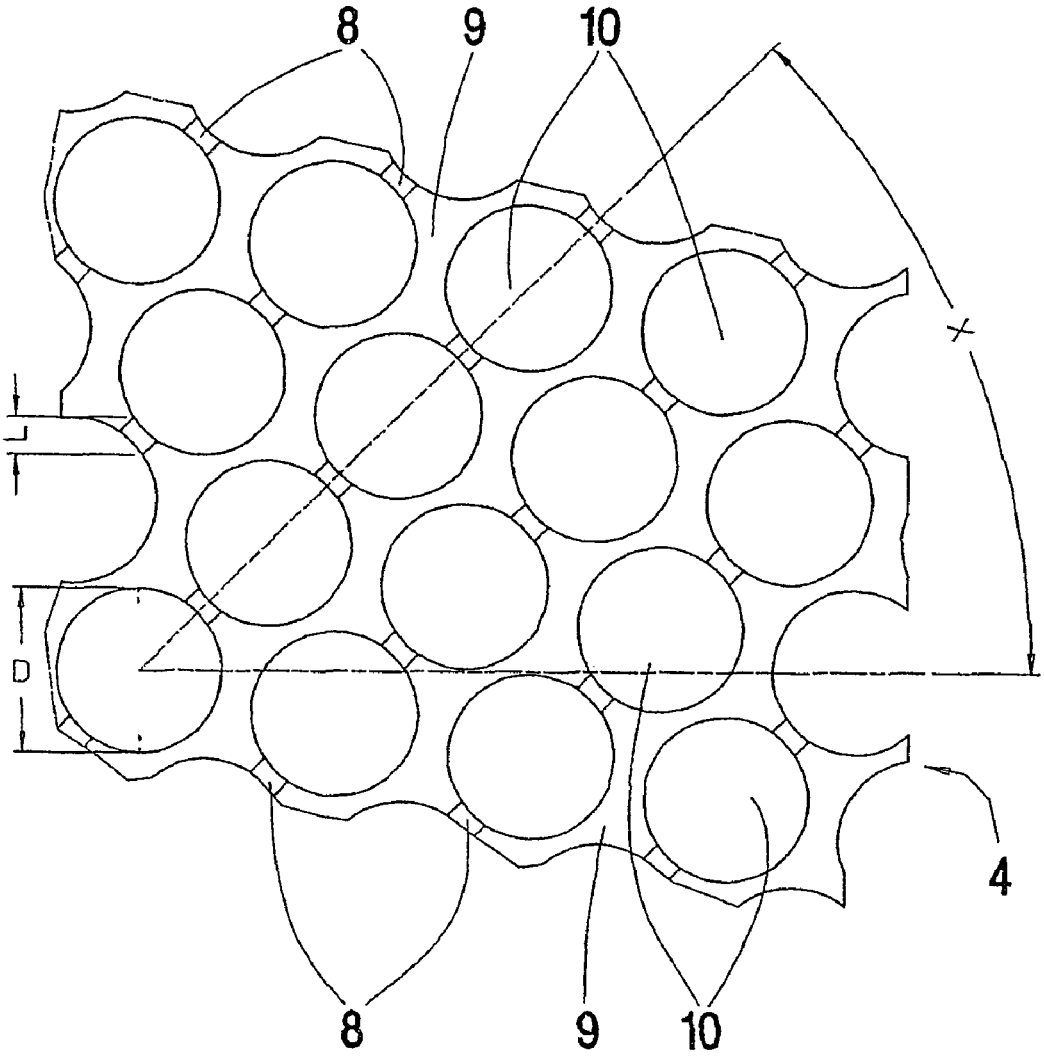

The feature that essentially distinguishes the embodiment in FIG. 5 from that in FIG. 4 is that there are only two non-recessed parts 8 of the solid parts which touch each perforation and that one non-recessed part 8 which touches two neighbouring perforations at its ends is situated on the line passing through the centres of these two perforations 10. The angle X of the line through these centres with a generator parallel to the axis of the drum is between 0 and 180°. In FIG. 4 it is 90°. The two non-recessed parts 8 which touch the same perforation do so at diametrically opposite points.

The width of the recessed parts 9 is 8 mm.

The invention claimed is:

1. A machine for entangling a non-woven fabric by means of water jets, comprising a drum, means for rotationally driving the drum, a sleeve having openings therethrough and a sleeve outer side face surrounding the drum and an injector system arranged so as to spray water jets over the sleeve outer side face characterized in that the drum has an axis and a side wall including perforations, said side wall being continuously solid between the perforations and extending to an outer side surface remote of the axis, said side wall including recessed and non-recessed portions that together form the side wall and the outer side surface, wherein every recessed portion intersects a perforation and all of the outer side surface has a cylindrical shape and is spaced the same radial distance from said axis with the exception of the recessed portions.

2. A machine according to claim 1, wherein said recessed and non-recessed portions have elongate shapes extending in a circumferential direction about the drum, and said recessed portions comprise individual grooves and/or hollows in said side wall and outer side surface that are separated by said non-recessed portions and/or perforations.

3. A machine according to claim 2, wherein the perforations are cylindrical or conical and said perforations intersect said recessed and non-recessed portions of said side wall.

4. A machine according to claim 1, wherein the perforations have a total perforation surface area extending in the outer side face and the outer side face has a total outer side face surface area which includes the total perforation surface area, and the ratio of the total perforation surface area and the total outer side face surface area is between 30% and 90%.

5. A machine according to claim 1, wherein the side wall of the drum has a minimum thickness between 1 mm and 60 mm.

6. A machine according to claim 1, wherein the recessed portions have a thickness or depth between 0.25 mm and 5 mm.

7. A machine according to claim 1, wherein the drum is made of metal.

8. A machine according to claim 1, wherein the perforations have a diameter between 3 mm and 20 mm.

9. A machine according to claim 1, wherein the non-recessed portions extending between two adjacent perforations have a length as measured along the outer side surface equal to from 30% to 100% of the diameter of a perforation.

10. A machine according to claim 1, wherein the non-recessed portions extending between two adjacent perforations have a width as measured along the outer side surface of between 0.6 mm and 4 mm.

11. A machine according to claim 1, wherein the recessed portions extending between two adjacent perforations are on a line extending along the outer side surface passing through the centers of the two perforations.

12. A machine according to claim 11, wherein there are only two non-recessed portions touching each perforation.

13. A machine according to claim 11, wherein the recessed portions have a total recessed portion surface area extending along the outer side surface and the non-recessed portions have a total non-recessed portion surface area extending along the outer side surface, and the ratio of the total recessed portion surface area to the total non-recessed portion surface area is between 70 and 95.

14. A process for manufacturing a non-woven with no marks or impressions imposed by a drum supporting the non-woven during impingement of spray water jets onto the non-woven comprising the steps of providing a machine as set forth in claim 1, passing a non-woven fabric formed of filaments over the sleeve outer side face and impinging water on the non-woven fabric to entangle the filaments.

15. A machine according to claim 1, wherein the drum has sufficient rigidity to support a perforated sleeve surrounding the drum side wall and carrying a non-woven fabric during spray water jet impingement, and the drum side wall perforations and recessed portions communicate to provide uniform drainage of water without imposing drum support marks or impressions on the non-woven fabric, wherein said sleeve is mounted on said drum over said cylindrical shape outer side surface to facilitate mounting and removal of the sleeve without damage.

16. A machine according to claim 15, wherein the recessed portions have a thickness between 0.25 mm and 5 mm, the perforations have a diameter between 3 mm and 20 mm, the perforations have a total perforation surface area extending in the outer side surface and the outer side surface has a total outer side surface area which includes the total perforation surface area, and the ratio of the total perforation surface area and the total outer side surface area is between 30% and 90%, and the recessed portions have a total recessed portion surface area extending along the outer side surface and the non-recessed portions have a total non-recessed portion surface area, and the ratio of the total recessed portion surface area to the total non-recessed portion surface area is between 70 and 95.

17. A machine according to claim 1, wherein the outer side surface with the exception of the recessed portions is in a single plane formed by a generator parallel to the drum axis.

18. A machine according to claim 1, wherein the side wall of the drum has a minimum thickness between 5 mm and 40 mm.

* * * * *